United States Patent [19]

Owen et al.

[11] Patent Number: 5,011,592

[45] Date of Patent: Apr. 30, 1991

[54] PROCESS FOR CONTROL OF MULTISTAGE CATALYST REGENERATION WITH FULL THEN PARTIAL CO COMBUSTION

[75] Inventors: Hartley Owen, Belle Mead, N.J.; Paul H. Schipper, Wilmington, Del.

[73] Assignee: Mobil Oil Corporation, Fairfax, Va.

[21] Appl. No.: 554,309

[22] Filed: Jul. 17, 1990

[51] Int. Cl.[5] ..... C10G 11/00

[52] U.S. Cl. ..... 208/113; 208/155; 208/159; 502/42; 502/43

[58] Field of Search ..... 208/113, 155, 159, 121; 502/42, 43

[56] References Cited

U.S. PATENT DOCUMENTS 4,211,636 7/1980 Gross et al. ..... 208/164
4,211,637 7/1980 Gross et al. ..... 208/164
4,664,778 5/1987 Reinkemeyer ..... 208/159
4,849,091 7/1989 Cabrera et al. ..... 108/113

*Primary Examiner*—Curtis R. Davis
*Assistant Examiner*—William Diemler
*Attorney, Agent, or Firm*—Alexander J. McKillop; Charles J. Speciale; Richard D. Stone

[57] ABSTRACT

A process for controlled, multi-stage regeneration of FCC catalyst is disclosed. A modified high efficiency catalyst regenerator, with a fast fluidized bed coke combustor, dilute phase transport riser, and second fluidized bed regenerates the catalyst in at least two stages. The primary stage of regeneration is in the coke combustor, at full CO oxidation conditions. The second stage of catalyst regeneration occurs in the second fluidized bed, at partial CO combustion conditions. The process permits regeneration of spent FCC catalyst while minimizing NOx exmissions and achieving significant reduction of SOx.

18 Claims, 6 Drawing Sheets

PROCESS FOR CONTROL OF MULTISTAGE CATALYST REGENERATION WITH FULL THEN PARTIAL CO COMBUSTION

BACKGROUND OF THE INVENTION

1. Field of the Invention

The field of the invention is regeneration of coked cracking catalyst in a fluidized bed.

2. Description of Related Art

Catalytic cracking is the backbone of many refineries. It converts heavy feeds to lighter products by cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425 C.-600 C., usually 460 C.-560 C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500 C.-900 C., usually 600 C.-750 C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite-containing catalysts having high activity and selectivity are now used in most FCC units. These catalysts work best when coke on the catalyst after regeneration is less than 0.2 wt %, and preferably less than 0.05 wt %.

To regenerate FCC catalysts to these low residual carbon levels, and to burn CO completely to $CO_2$ within the regenerator (to conserve heat and minimize air pollution) many FCC operators add a CO combustion promoter metal to the catalyst or to the regenerator.

U.S. Pat. No. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade a wider range of feedstocks, in particular, feedstocks that were heavier, and also contained more metals and sulfur than had previously been permitted in the feed to a fluid catalytic cracking unit.

These heavier, dirtier feeds have placed a growing demand on the regenerator. Processing resids has exacerbated four existing problem areas in the regenerator, sulfur, steam, temperature and NOx. These problems will each be reviewed in more detail below.

SULFUR

Much of the sulfur in the feed ends up as SOx in the regenerator flue gas. Higher sulfur levels in the feed, combined with a more complete regeneration of the catalyst in the regenerator increases the amount of SOx in the regenerator flue gas. Some attempts have been made to minimize the amount of SOx discharged to the atmosphere through the flue gas by including catalyst additives or agents to react with the SOx in the flue gas. These agents pass with the regenerated catalyst back to the FCC reactor where the reducing atmosphere releases the sulfur compounds as $H_2S$. Suitable agents are described in U.S. Pat. Nos. 4,071,436 and 3,834,031. Use of cerium oxide agent for this purpose is shown in U.S. Pat. No. 4,001,375.

Unfortunately, the conditions in most FCC regenerators are not the best for SOx adsorption. The high temperatures in modern FCC regenerators (up to 870 C. (1600 F.)) impair SOx adsorption. One way to minimize SOx in flue gas is to pass catalyst from the FCC reactor to a long residence time steam stripper, as disclosed in U.S. Pat. No. 4,481,103 to Krambeck et al which is incorporated by reference. This process preferably steam strips spent catalyst at 500-550 C. (932 to 1022 F.), which is beneficial but not sufficient to remove some undesirable sulfur- or hydrogen-containing components.

It is usually essential to have highly oxidizing conditions for efficient SOx capture, but these conditions usually are accompanied by high temperatures, in modern FCC regenerators.

STEAM

Steam is always present in FCC regenerators although it is known to cause catalyst deactivation. Steam is not intentionally added, but is invariably present, usually as absorbed or entrained steam from steam stripping of catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from an FCC stripper to an FCC regenerator contains hydrogen-containing components, such as coke or unstripped hydrocarbons adhering thereto. This hydrogen burns in the regenerator to form water and cause hydrothermal degradation.

U.S. Pat. No. 4,336,160 to Dean et al, which is incorporated by reference, attempts to reduce hydrothermal degradation by staged regeneration.

Steaming of catalyst becomes more of a problem as regenerators get hotter. Higher temperatures accelerate the deactivating effects of steam.

Temperature

Regenerators are operating at higher and higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator gets hotter, and the extra heat is rejected as high temperature flue gas. Many refiners severely limit the amount of resid or similar high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by Occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio produced in the regenerator. Burning coke partially to CO produces less heat than complete combustion to CO2. Control of CO/CO2 ratios is fairly straightforward in single, bubbling bed regenerators, by limiting the amount of air that is added. It is far more difficult to control CO/CO2 ratios when multi-stage regeneration is involved.

U.S. Pat. No. 4,353,812 to Lomas et al, which is incorporated by reference, discloses cooling catalyst from a regenerator by passing it through the shell side of a heat-exchanger with a cooling medium through the tube side. The cooled catalyst is recycled to the regeneration zone. This approach will remove heat from the regenerator, but will not prevent poorly, or even well, stripped catalyst from experiencing very high surface or localized temperatures in the regenerator.

The prior art also used dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper: 2,873,175 to Owens; 2,862,798 to McKinney; 2,596,748 to Watson et al; 2,515,156 to Jahnig et al; 2,492,948 to Berger; and 2,506,123 to Watson.

NOx

Burning of nitrogenous compounds in FCC regenerators has long led to creation of minor amounts of NOx, some of which were emitted with the regenerator flue gas. Usually these emissions were not much of a problem because of relatively low temperature, a relatively reducing atmosphere from partial combustion of CO and the absence of catalytic metals like Pt in the regenerator which increase NOx production.

Unfortunately, the trend to heavier feeds usually means that the amount of nitrogen compounds on the coke will increase and that NOx emissions will increase. Higher regenerator temperatures also tend to increase NOx emissions.

It would be beneficial, in many FCC regenerators, to have a way to burn at least a large portion of the nitrogenous coke in a relatively reducing atmosphere, so that much of the NOx formed could be converted into N2 within the regenerator. Conditions which minimize NOx such as reducing conditions tend to increase CO emissions and impair the capture of SOx from flue gas, in existing multi-stage regenerator designs.

High Efficiency Regenerator. Most new FCC units use a high efficiency regenerator, which uses a fast fluidized bed coke combustor to burn most of the coke from the catalyst, and a dilute phase transport riser above the coke combustor to afterburn CO to CO2 and achieve a limited amount of additional coke combustion. Hot regenerated catalyst and flue gas are discharged from the transport riser, separated, and the regenerated catalyst collected as a second bed, a bubbling dense bed, for return to the FCC reactor and recycle to the coke combustor to heat up incoming spent catalyst.

Such regenerators are now widely used. They typically are operated to achieve complete CO combustion within the dilute phase transport riser. They achieve one stage of regeneration, i.e., essentially all of the coke is burned in the coke combustor, with minor amounts being burned in the transport riser. The residence time of the catalyst in the coke combustor is on the order of a few minutes, while the residence time in the transport riser is on the order of a few seconds, so there is generally not enough residence time of catalyst in the transport riser to achieve any significant amount of coke combustion.

Catalyst regeneration in such high efficiency regenerators is essentially a single stage of regeneration, in that the catalyst and regeneration gas and produced flue gas remain together from the coke combustor through the dilute phase transport riser. Almost no further regeneration of catalyst occurs downstream of the coke combustor, because very little air is added to the second bed, the bubbling dense bed used to collect regenerated catalyst for recycle to the reactor or the coke combustor. Usually enough air is added to fluff the catalyst, and allow efficient transport of catalyst around the bubbling dense bed. Less than 5 %, and usually less than 1 %, of the coke combustion takes place in the second dense bed.

Such units are popular in part because of their efficiency, i.e., the fast fluidized bed, with recycle of hot regenerated catalyst, is so efficient at burning coke that the regenerator can operate with only half the catalyst inventory required in an FCC unit with a bubbling dense bed regenerator.

With the trend to heavier feedstocks, the catalyst regenerator is frequently pushed to the limit of its coke burning capacity. Addition of cooling coils, as discussed above in the Temperature discussion, helps some, but causes additional problems. High efficiency regenerators run best when run in complete CO combustion mode, so attempts to shift some of the heat of combustion to a downstream CO boiler are difficult to implement.

We realized that there was a need for a better way to run a high efficiency regenerator, so that several stages of catalyst regeneration could be achieved in the existing hardware. We also wanted a reliable and efficient way of controlling the amount of regeneration that occurred in each stage, so that the heretofore relatively inactive second fluidized bed could accomplish some useful catalyst regeneration.

We also wanted to devise a way to run existing high efficiency regenerators so that complete CO combustion could be achieved in the coke combustor/transport riser, while shifting some of the coke combustion to the second fluidized bed, and while mainintaing the second fluidized bed under partial CO oxidation conditions.

We knew this would present difficult control problems, because essentially all commercial experience with these units has been in single stage operation, with complete CO combustion. Maintaining partial CO combustion in the second stage, or second fluidized bed, of a high efficiency regenerator is a challenge.

Part of the problem of multi-stage regeneration, with partial CO burn in the second stage only, is the difficulty of ensuring that the proper amount of coke burning occurs in each stage. If the unit operation does not change, then frequent material or carbon balances around the regenerator can be used to adjust the amount of combustion air that is added to each stage of the regenerator. Unfortunately, the only certainty in commercial FCC operation is change. Feed quality frequently changes, the product slate required varies greatly between winter and summer, catalyst ages, and equipment breaks. If coke burning gets behind, in e.g., the second stage of the regenerator, the unit must be able to catch up on coke burning in the first stage, so that the second stage can still remove the desired amount of carbon without shifting into complete CO combustion mode.

We studied these units, and realized that were several ways to reliably achieve two stages of combustion, while keeping the first stage operating in complete CO combustion, and the second stage in partial CO combustion mode.

Our control method reduces hydrothermal degradation of catalyst and increases the coke burning capacity of existing high efficiency regenerators without requiring significant additional vessel construction. Regenerator temperatures can be reduced somewhat for some parts of the regeneration. We discovered we could greatly reduce NOx emissions, while retaining the ability to capture significant amounts of SOx. We are also able to mitigate to some extent the formation of highly oxidized forms of vanadium, permitting the unit to tolerate higher metals levels without excessive loss of catalyst activity or adverse effects in the cracking reactor.

BRIEF SUMMARY OF THE INVENTION

Accordingly, the present invention provides a fluidized catalytic cracking process wherein a heavy hydrocarbon feed comprising hydrocarbons and sulfur and nitrogen compounds and having a boiling point above about 650 F. is catalytically cracked to lighter products comprising the steps of: catalytically cracking the feed in a catalytic cracking zone operating at catalytic cracking conditions by contacting the feed with a source of hot regenerated catalyst to produce a cracking zone effluent mixture having an effluent temperature and comprising cracked products and spent cracking catalyst containing strippable hydrocarbons and coke containing nitrogen and sulfur compounds; separating the cracking zone effluent mixture into a cracked product rich vapor phase and a solids rich phase comprising the spent catalyst and strippable hydrocarbons; stripping the separated spent catalyst with a stripping gas to remove strippable compounds from spent catalyst and produce stripped catalyst; regenerating said stripped catalyst in a primary regeneration stage, comprising a fast fluidized bed coke combustor having at least one inlet for primary combustion gas and for spent catalyst, and an overhead outlet for at least partially regenerated catalyst and flue gas, and also comprising a contiguous, superimposed, dilute phase transport riser having an opening at the base connective with the coke combustor and an outlet at an upper portion thereof for discharge of partially regenerated catalyst and primary flue gas, at primary regeneration conditions adapted to completely afterburn CO formed during coke combustion to CO2, and sufficient to burn at least 40 % of the coke and sulfur compounds on the catalyst under oxidizing conditions while retaining at least 30% of the nitrogen compounds on said catalyst to produce partially regenerated catalyst containing nitrogen compounds and flue gas comprising SOx; discharging and separating the primary flue gas from partially regenerated catalyst and collecting said partially regenerated catalyst as a second fluidized bed of partially regenerated catalyst in a secondary regeneration zone maintained at catalyst regeneration conditions and regenerating under partial CO oxidation conditions said partially regenerated catalyst to remove additional coke from said catalyst and to burn the nitrogen compounds present in said stripped catalyst under reducing conditions to produce regenerated catalyst and a secondary flue gas stream comprising at least 1 mole % CO; and recycling to the catalytic cracking process hot regenerated catalyst from said second fluidized bed.

In another embodiment, the present invention provides a process for regenerating spent fluidized catalytic cracking catalyst used in a catalytic cracking process wherein a heavy hydrocarbon feed stream is preheated in a preheating means, catalytically cracked in a cracking reactor by contact with a source of hot, regenerated cracking catalyst to produce cracked products and spent catalyst which is regenerated in a high efficiency fluidized catalytic cracking catalyst regenerator comprising a fast fluidized bed coke combustor having at least one inlet for spent catalyst, at least one inlet for regeneration gas, and an outlet to a superimposed dilute phase transport riser having an inlet at the base connected to the coke combustor and an outlet the top connected to a separation means which separates catalyst and primary flue gas and discharges catalyst into a second fluidized bed, to produce regenerated cracking catalyst comprising regenerating said spent catalyst in at least two stages, and maintaining the first stage in complete CO combustion and the second stage in partial CO combustion by: partially regenerating said spent catalyst with a controlled amount, sufficient to burn from 10 to 90 % of the coke on the spent catalyst to carbon oxides, of a primary regeneration gas comprising oxygen or an oxygen containing gas in a primary regeneration zone comprising said coke combustor and transport riser operating at primary catalyst regeneration conditions sufficient to completely afterburn CO produced during coke combustion to CO2 and discharging from the transport riser partially regenerated catalyst and a primary flue gas stream; completing the regeneration of said partially regenerated catalyst with a set amount of a secondary regeneration gas comprising oxygen or an oxygen containing gas in a secondary regeneration zone comprising a second fluidized bed operating at secondary catalyst regeneration conditions sufficient to limit the combustion of CO to CO2 and burn additional coke to carbon oxides and regenerate said catalyst.

DETAILED DESCRIPTION

Figure 1:
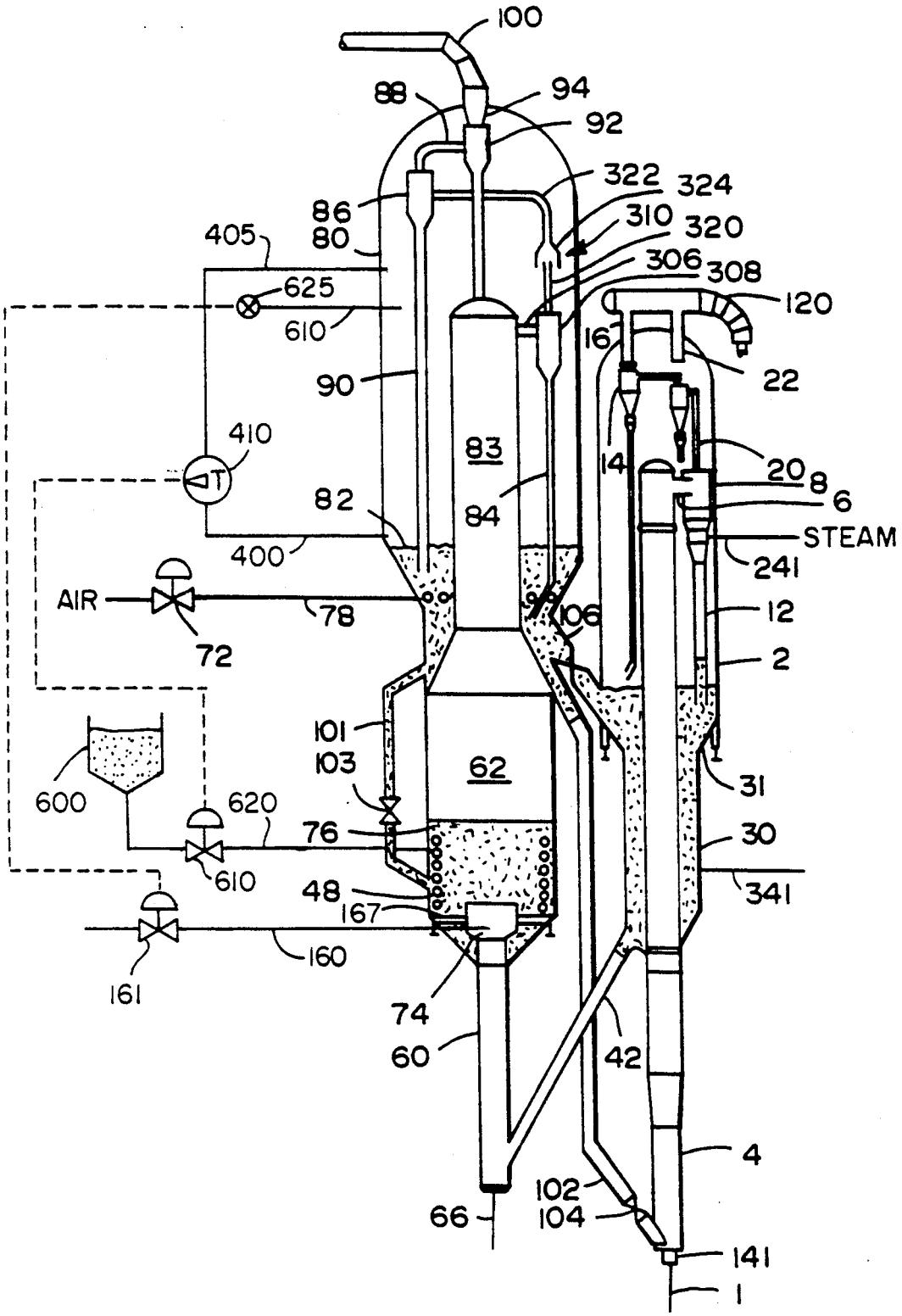
FIG. 1 is a simplified schematic view of one embodiment of the invention using a flue gas composition to control addition of air to the second stage of a multistage FCC high efficiency regenerator, and a delta T to control addition of CO combustion promoter.

The present invention can be better understood by reviewing it in conjunction with the Figures, which illustrate preferred high efficiency regenerators incorporating the process control scheme of the invention. The present invention is applicable to other types of high efficiency regenerators, such as those incorporating additional catalyst flue gas separation means in various parts of the regenerator.

In all figures the FCC reactor section is the same. A heavy feed is charged via line 1 to the lower end of a riser cracking FCC reactor 4. Hot regenerated catalyst is added via standpipe 102 and control valve 104 to mix with the feed. Preferably, some atomizing steam is added via line 141 to the base of the riser, usually with the feed . With heavier feeds, e.g., a resid, 2–10 wt.% steam may be used. A hydrocarbon-catalyst mixture rises as a generally dilute phase through riser 4. Cracked products and coked catalyst are discharged via riser effluent conduit 6 into first stage cyclone 8 in vessel 2. The riser top temperature, the temperature in conduit 6, ranges between about 480 and 615 C. (900 and 1150 F.), and preferably between about 538 and 595 C. (1000 and 1050 F.). The riser top temperature is usually controlled by adjusting the catalyst to oil ratio in riser 4 or by varying feed preheat.

Cyclone 8 separates most of the catalyst from the cracked products and discharges this catalyst down via dipleg 12 to a stripping zone 30 located in a lower portion of vessel 2. Vapor and minor amounts of catalyst exit cyclone 8 via gas effluent conduit 20 second stage reactor cyclones 14. The second cyclones 14 recovers some additional catalyst which is discharged via diplegs to the stripping zone 30.

The second stage cyclone overhead stream, cracked products and catalyst fines, passes via effluent conduit 16 and line 120 to product fractionators not shown in the figure. Stripping vapors enter the atmosphere of the vessel 2 and may exit this vessel via outlet line 22 or by passing through an annular opening in line 20, not shown, i.e. the inlet to the secondary cyclone can be flared to provide a loose slip fit for the outlet from the primary cyclone.

The coked catalyst discharged from the cyclone diplegs collects as a bed of catalyst 31 in the stripping zone 30. Dipleg 12 is sealed by being extended into the catalyst bed 31. The dipleg from the secondary cyclones 14 is sealed by a flapper valve, not shown.

Many cyclones, 4 to 8, are usually used in each cyclone separation stage. A preferred closed cyclone system is described in U.S. Pat. No. 4,502,947 to Haddad et al, which is incorporated by reference.

The FCC reactor system described above is conventional and forms no part of the present invention.

Stripper 30 is a "hot stripper." Hot stripping is preferred, but not essential. Spent catalyst is mixed in bed 31 with hot catalyst from the regenerator. Direct contact heat exchange heats spent catalyst. The regenerated catalyst, which has a temperature from 55 C. (100 F.) above the stripping zone 30 to 871 C. (1600 F.), heats spent catalyst in bed 31. Catalyst from regenerator 80 enters vessel 2 via transfer line 106, and slide valve 108 which controls catalyst flow. Adding hot, regenerated catalyst permits first stage stripping at from 55 C. (100 F.) above the riser reactor outlet temperature and 816 C. (1500 F.). Preferably, the first stage stripping zone operates at least 83 C. (150 F.) above the riser top temperature, but below 760 C. (1400 F.).

In bed 31 a stripping gas, preferably steam, flows countercurrent to the catalyst. The stripping gas is preferably introduced into the lower portion of bed 31 by one or more conduits 341. The stripping zone bed 31 preferably contains trays or baffles not shown.

High temperature stripping removes coke, sulfur and hydrogen from the spent catalyst. Coke is removed because carbon in the unstripped hydrocarbons is burned as coke in the regenerator. The sulfur is removed as hydrogen sulfide and mercaptans. The hydrogen is removed as molecular hydrogen, hydrocarbons, and hydrogen sulfide. The removed materials also increase the recovery of valuable liquid products, because the stripper vapors can be sent to product recovery with the bulk of the cracked products from the riser reactor. High temperature stripping can reduce coke load to the regenerator by 30 to 50% or more and remove 50–80% of the hydrogen as molecular hydrogen, light hydrocarbons and other hydrogen-containing compounds, and remove 35 to 55% of the sulfur as hydrogen sulfide and mercaptans, as well as a portion of nitrogen as ammonia and cyanides.

Although a hot stripping zone is shown in FIG. 1, the present invention is not, per se, the hot stripper. The process of the present invention may also be used with conventional strippers, or with long residence time steam strippers, or with strippers having internal or external heat exchange means.

Although not shown in FIG. 1, an internal or external catalyst stripper/cooler, with inlets for hot catalyst and fluidization gas, and outlets for cooled catalyst and stripper vapor, may also be used where desired to cool stripped catalyst before it enters the regenerator. Although much of the regenerator is conventional (the coke combustor, dilute phase transport riser and second dense bed) several significant departures from conventional operation occur.

There is regeneration of FCC catalyst in two stages, i.e., both in the coke combustor/transport riser and in the second dense bed. Complete CO combustion is maintained in the first, but not the second stage of catalyst regeneration, and reliably controlled in a way that accommodates changes in unit operation. The unit preferably operates with far higher levels of CO combustion promoter, such as Pt, as compared to conventional high efficiency regenerators.

In the FIG. 1 embodiment, the second stage air addition rate is held relatively constant, while air addition to the first stage of regeneration, i.e., the coke combustor, is controlled based on the CO content of the flue gas from the second stage. A similar control signal is developed, based on a delta T associated with the flue gas, to adjust the amount of CO combustion promoter present in, or added to, the first stage. Conditions in the coke combustor are set to achieve complete CO combustion, but only partial coke combustion, while conditions in the second stage of regeneration are set to finish burning off the desired amount of coke, while maintaining partial CO combustion.

The stripped catalyst passes through the conduit 42 into regenerator riser 60. Air from line 66 and cooled catalyst combine and pass up through an air catalyst disperser 74 into coke combustor 62 in regenerator 80. In bed 62, combustible materials, such as coke on the catalyst, are burned by contact with air or oxygen containing gas.

The amount of air or oxygen containing gas added via line 66, to the base of the riser mixer 60, is preferably constant and preferably restricted to 10–95% of total air addition to the first stage of regeneration. Additional air, preferably 5–75 % of total air, is controllably added to the coke combustor via flow control valve 161, line 160 and air ring 167. In this way the first stage of regeneration in regenerator 80 can be done with a controlled, and variable, air addition rate. Partitioning of the first stage air, between the riser mixer 60 and the air ring 167 in the coke combustor, can be controlled by a differential temperature, e.g., temperature rise in riser mixer 60. The total amount of air addition to the first stage, i.e., the regeneration in the coke combustor and riser mixer, should be constant, and should be large enough to remove much of the coke on the catalyst, preferably at least 50 % and most preferably at least 75 %.

The temperature of fast fluidized bed 76 in the coke combustor 62 may be, and preferably is, increased by recycling some hot regenerated catalyst thereto via line 101 and control valve 103. If temperatures in the coke combustor are too high, some heat can be removed via catalyst cooler 48, shown as tubes immersed in the fast fluidized bed in the coke combustor. Very efficient heat transfer can be achieved in the fast fluidized bed, so it may be in some instances beneficial to both heat the coke combustor (by recycling hot catalyst to it) and to cool the coke combustor (by using catalyst cooler 48) at the same time. Neither catalyst heating by recycle, nor catalyst cooling, by the use of a heat exchange means, per se form any part of the present invention.

In coke combustor 62 the combustion air, regardless of whether added via line 66 or 160, fluidizes the catalyst in bed 76, and subsequently transports the catalyst continuously as a dilute phase through the regenerator riser 83. The dilute phase passes upwardly through the riser 83, through riser outlet 306 into primary regenerator cyclone 308. Catalyst is discharged down through dipleg 84 to form a second relatively dense bed of catalyst 82 located within the regenerator 80.

While most of the catalyst passes down through the dipleg 84, the flue gas and some catalyst pass via outlet 310 into enlarged opening 324 of line 322. This ensures that most of the flue gas created in the coke combustor or dilute phase transport riser, and most of the water of combustion present in the flue gas, will be isolated from, and quickly removed from, the atmosphere of vessel 80. The flue gas from the regenerator riser cyclone gas outlet is almost immediately charged via lines 320 and 322 into the inlet of another cyclone separation stage, cyclone 86. An additional stage of separation of catalyst from flue gas is achieved, with catalyst recovered via dipleg 90 and flue gas discharged via gas exhaust line 88. Preferably flue gas is discharged to yet a third stage of cyclone separation, in third stage cyclone 92. Flue gas, with a greatly reduced solids content is discharged from the regenerator 80 and from cyclone 92 via exhaust line 94 and line 100.

The hot, regenerated catalyst discharged from the various cyclones forms the bed 82, which is substantially hotter than any other place in the regenerator, and hotter than the stripping zone 30. Bed 82 is at least 55 C. (100 F.) hotter than stripping zone 31, and preferably at least 83 C. (150 F.) hotter. The regenerator temperature is, at most, 871 C. (1600 F.) to prevent deactivating the catalyst.

A fixed amount of air is added via valve 72 and line 78 to second fluidized bed 82. Bed 82 will usually be a bubbling dense bed, although a turbulent or fast fluidized bed is preferred. Regardless of density or fluidization regime, this bed preferably contains significantly more catalyst inventory than has previously been used in high efficiency regenerators. Adding inventory and adding combustion air to second dense bed 82 shifts some of the coke combustion to the relatively dry atmosphere of second fluidized bed 82, and minimizes hydrothermal degradation of catalyst. The additional inventory, and increased residence time, in bed 82 permit 5 to 75 %, and preferably 10 to 60 % and most preferably 15 to 50 %, of the coke content on spent catalyst to be removed under relatively dry conditions. This is a significant change from the way high efficiency regenerators have previously operated, with limited catalyst inventories in the second dense bed 82, and essentially no catalyst regeneration.

The air addition rate to the second fluidized bed, bed 82, is fixed, in this embodiment, to provide a constant amount of air addition which should be less than that normally needed to achieve complete CO combustion.

The air addition rate, and/or the rate of addition of CO oxidation promoter to the first stage, i.e., the coke combustor, via line 160, is adjusted to maintain complete CO combustion, but only partial coke combustion, in the first stage. As long as conditions are right, it is possible to essentially completely afterburn all the CO to CO2 in the coke combustor/transport riser, even though all of the coke is not removed from the catalyst. The easiest way to achieve this is usually by ensuring that sufficient CO combustion promoter is present. Limiting residence time, and to a lesser extent temperature, in the coke combustor/transport riser will limit the amount of coke that is burned, while the presence of Pt, and to a lesser extent the existence of dilute phase conditions, will ensure that such CO as is formed will be burned completely to CO2.

A predetermined amount of air is added to the second stage of regeneration which is insufficient to achieve complete CO combustion. If the primary stage does not burn enough coke, the coke will show up in the second stage, and the desired amount of coke will still usually be burned, but the CO/CO2 ratio of the flue gas will vary.

In the FIG. 1 embodiment, flue gas analyzers such as CO analyzer controller 625 and probe 610 monitor composition of vapor in the dilute phase region above the second fluidized bed. There is no direct measurement of complete CO oxidation, the conditions in the coke combustor must be set to assure complete CO oxidation, which can be confirmed by periodic carbon balances, flue gas analysis of the combined flue gas streams, or of the flue gas from the transport riser or equivalent means. It is also possible, and will be preferred in some installations, to measure the composition of the combined flue gas streams, or the flue gas emanating from the transport riser.

Although CO monitoring is preferred in the partial combustion stage, it is also possible to monitor oxygen concentration in the flue gas, as excess oxygen will react rapidly with free CO.

The flue gas composition, or a delta T indicative thereof, can also directly adjust the amount of CO combustion promoter added from hopper 600 via valve 610 and line 610 to the coke combustor, or elsewhere. The CO combustion promoter can be conventional materials, such as Pt on alumina, a solution of platinum dissolved in an aqueous or hydrocarbon phase, or any other equivalent source of CO combustion promoter. The promoter can be added to the coke combustor, as shown in the Figure, or to any other part of the FCC unit, i.e., mixed with the heavy feed to the riser reactor, added to the second fluidized bed, etc.

If a high CCR feed is charged to the unit, the coke make will increase, and the unit will deal with the increased coke burning requirement as follows. The carbon content on catalyst from the first stage of regeneration, will increase. This will increase the CO content of the flue gas above the second fluidized bed, which will be observed by analyzer controller 625. The controller will call for more primary combustion air to the coke combustor. This increased combustion air will burn more carbon in the coke combustor and restore the unit to complete CO combustion in the first stage. Coke combustion in the first stage is limited by residence time, and by the nature of coke combustion, i.e., the less coke there is on catalyst the more difficult it is to remove it.

Some fine tuning of the unit is both possible and beneficial. The amount of air added at each stage (riser mixer 60, coke combustor 62, transport riser 83, and second dense bed 82) is preferably set to maximize hydrogen combustion at the lowest possible temperature, and postpone as much carbon combustion until as late as possible, with highest temperatures reserved for the last stage of the process. In this way, most of the water of combustion, and most of the extremely high transient temperatures due to burning of poorly stripped hydrocarbon occur in riser mixer 60 where the catalyst is coolest. The steam formed will cause hydrothermal degradation of the zeolite, but the temperature will be lower so activity loss will be minimized. Shifting coke burning to the second dense bed will limit the highest temperatures to the driest part of the regenerator. The water of combustion formed in the riser mixer, or in the coke combustor, will not contact catalyst in the second dense bed 82, because of the catalyst flue gas separation which occurs exiting the dilute phase transport riser 83.

Preferably, some hot regenerated catalyst is withdrawn from dense bed 82 and passed via line 106 and control valve 108 into dense bed of catalyst 31 in stripper 30. Hot regenerated catalyst passes through line 102 and catalyst flow control valve 104 for use in heating and cracking of fresh feed.

FIG. 2 EMBODIMENT

Figure 2:
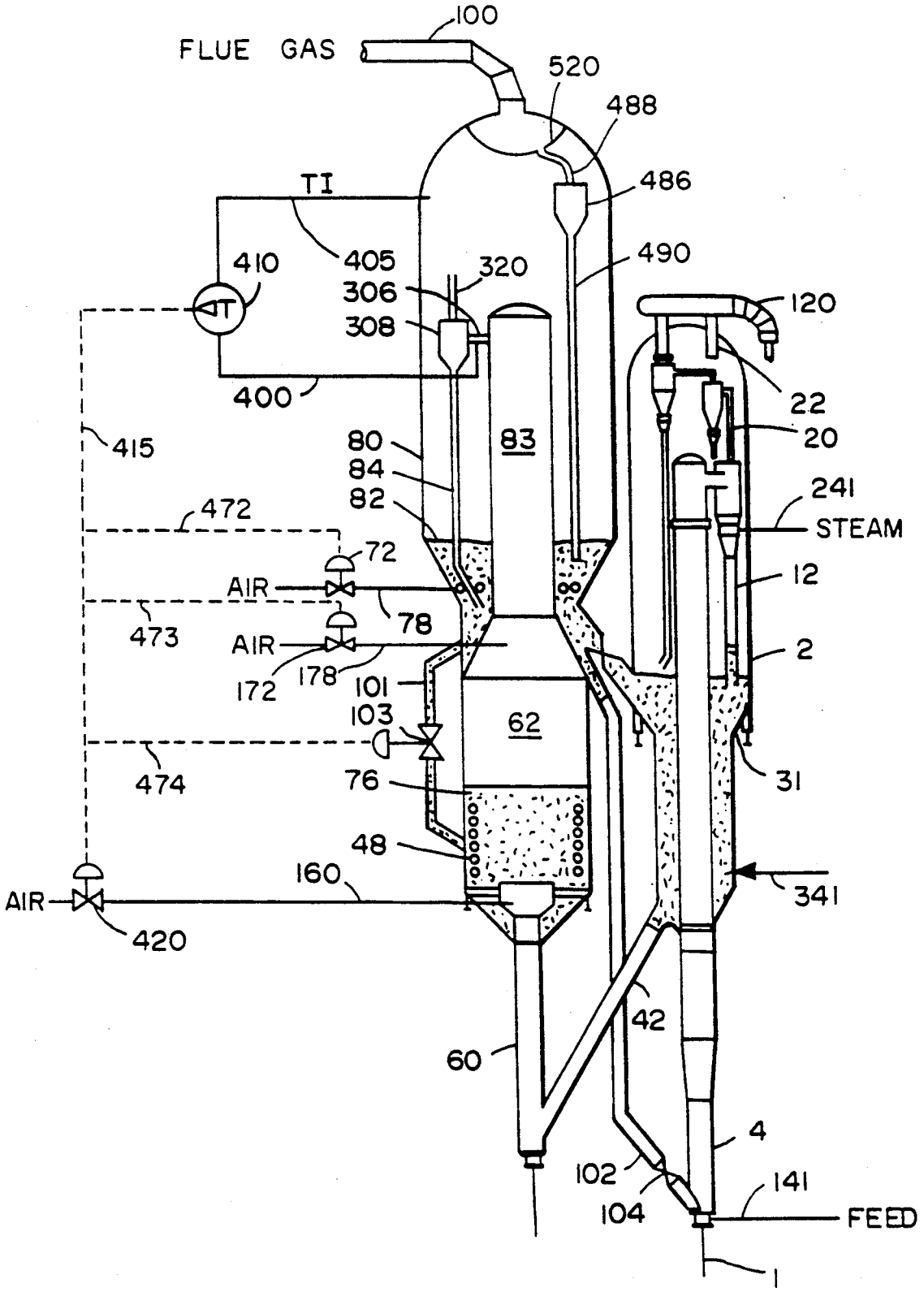
FIG. 2 is a simplified schematic view of an embodiment of the invention using a delta T indicative of a combined flue gas composition, to control air addition to the second fluidized bed, air addition to the transport riser and/or recycle of catalyst to the coke combustor

In FIG. 2, elements which correspond to elements in FIG. 1 have the same numbers, e.g., riser reactor 4 is the same in both figures. The reactor section, stripping section, riser mixer, coke combustor and transport riser are essentially the same in both figures. The differences relate to isolation of the various flue gas streams from the regenerator and the way that addition of air to the various zones is controlled.

In the FIG. 2 embodiment, a delta T controller adjusts air flow to the coke combustor or (preferably) to the inlet to the transport riser and/or adjusts catalyst recirculation to the coke combustor and/or the air rate to the second fluidized bed.

Differential temperature controller 410 receives signals from thermocouples or other temperature sensing means responding to temperatures in the inlet and vapor outlet of cyclone 308 associated with the regenerator transport riser outlet. A change in temperature, delta T, indicates afterburning. An appropriate signal is then sent via control line 415 to at least one of three places. This delta T signal can be transmitted via means 472 to alter secondary air addition by changing the setting on valve 72 in line 78. The dT signal can be transmitted via means 473 to control air flow to the inlet to the dilute phase transport riser via flow control valve 172 and air line 178. The dT signal can be transmitted via means 474 to alter catalyst recirculation by changing the setting on valve 103 in catalyst recirculation line 101.

Control of the rate of addition of air to the transport riser inlet will provide one of the most direct and sensitive ways of ensuring complete CO combustion in the transport riser, while limiting coke combustion in the coke combustor. This is because the catalyst residence time in the transport riser is so short that little coke combustion can occur. The air that is added to the dilute phase transport riser can, in the dilute phase condition, and preferably in the presence of somewhat larger amounts of CO combustion promoter than is customary, rapidly afterburn essentially all of the CO produced by coke combustion in the fast fluidized bed.

Operation with constant air to stage one, and variable air to stage 2, is also possible, and works best with relatively large amounts of CO combustion promoter. The CO combustion promoter assures complete afterburning in the first stage, and the swings in carbon production are accommodated in the second stage by adding more or less air. If the unit gets behind in coke burning, the carbon on catalyst in, and CO content of the flue gas from, the second fluidized bed will both increase. This will lead to an increase in afterburning, which will call for a compensating increase in air addition to the second fluidized bed.

Although the FIG. 2 embodiment keeps air addition to the coke combustor relatively constant, it usually will be preferred to keep the second stage operation (second dense bed) relatively constant, and vary the operation of the first stage (fast fluidized bed coke combustor).

The fast fluidized bed coke combustor responds more predictably to changes in air/catalyst flow than will a bubbling fluidized bed, or even a turbulent fluidized bed. Most high efficiency regenerators will have bubbling fluidized beds as the second dense bed, which do not respond as linearly as the coke combustor to changes in unit operation.

Control of coke burning in each stage is also possible by adjusting the amount of catalyst that is recycled from the second fluidized bed to the first. If no catalyst is recycled, very low carbon burning rates will be achieved in the coke combustor and much of the coke burning will be shifted to the second fluidized bed. As catalyst recycle rates are increased, the temperature of the catalyst mixture in the coke combustor will increase, which will increase the rate of carbon burning. If the secondary air, via line 78, is fixed, and the unit experiences afterburning, it is possible to shift more coke burning to the first stage by increasing the amount of catalyst recycle from the second fluidized bed to the coke combustor.

Regardless of the control method used in the FIG. 2 embodiment, i.e., whether secondary air or catalyst recirculation or both are used, the catalyst will experience two stages of regeneration which are very similar to those of the FIG. 1 embodiment. Flue gas and catalyst discharged from the dilute phase transport riser are charged via line 306 to a cyclone separator 308. Catalyst is discharged down via dipleg 84 to second fluidized bed 82. Flue gas, and water of combustion present in the flue gas, are discharged from cyclone 308 via line 320. The flue gas discharged from cyclone 308 mixes with flue gas from the second regeneration stage and passes through a second cyclone separation stage 486. Catalyst recovered in this second stage of cyclone separation is discharged via dipleg 490, which is sealed by being immersed in second fluidized bed 82. The cyclone dipleg could also be sealed with a flapper valve. Flue gas from the second stage cyclone 486 is charged via line 486 to plenum 520, then removed via flue gas outlet 100.

The flue gas stream generated by coke combustion in second fluidized bed 82 will be very hot and very dry. It will be hot because the second fluidized bed is usually the hottest place in a high efficiency regenerator. It will be dry because all of the "fast coke" or hydrogen content of the coke will have been burned from the catalyst upstream of the second fluidized bed, and catalyst in the second fluidized bed is fairly well isolated from the water laden flue gas discharged from the first regeneration stage. The coke exiting the transport riser outlet will have an exceedingly low hydrogen content, less than 5%, and frequently less than 2% or even 1%. This coke can be burned in the second fluidized bed without forming much water of combustion.

The hot dry flue gas produced by coke combustion in bed 82 usually has a lower fines/catalyst content than flue gas from the transport riser. This can be pronounced when the superficial vapor velocity in bubbling dense bed 82 is much less than the vapor velocity in the fast fluidized bed coke combustor. The coke combustor and transport riser work effectively because all of the catalyst is entrained out of them, while the second fluidized bed works best when none of the catalyst is carried into the dilute phase. This reduced vapor velocity in the second fluidized bed permits use of a single stage cyclone 486 to recover entrained catalyst from dry flue gas above the second fluidized bed. The catalyst recovered is discharged down via dipleg 490 to return to the second fluidized bed. The hot, dry flue gas from the second stage of combustion mixes with the water laden flue gas discharged from the first regeneration stage, and the combined flue gas streams pass through cyclone 486, with the flue gas discharged via cyclone outlet 488, plenum 520, and vessel outlet 100.

The FIG. 1 embodiment keeps the operation of the second regeneration stage at steady state, and modifies the operation of the first stage to accommodate different coke makes. The FIG. 2 embodiment generally keeps operation of the first stage coke combustor constant.

In general, either embodiment can use flue gas analysis, or a dT indicative of a flue gas composition, to adjust operation.

Figure 3:
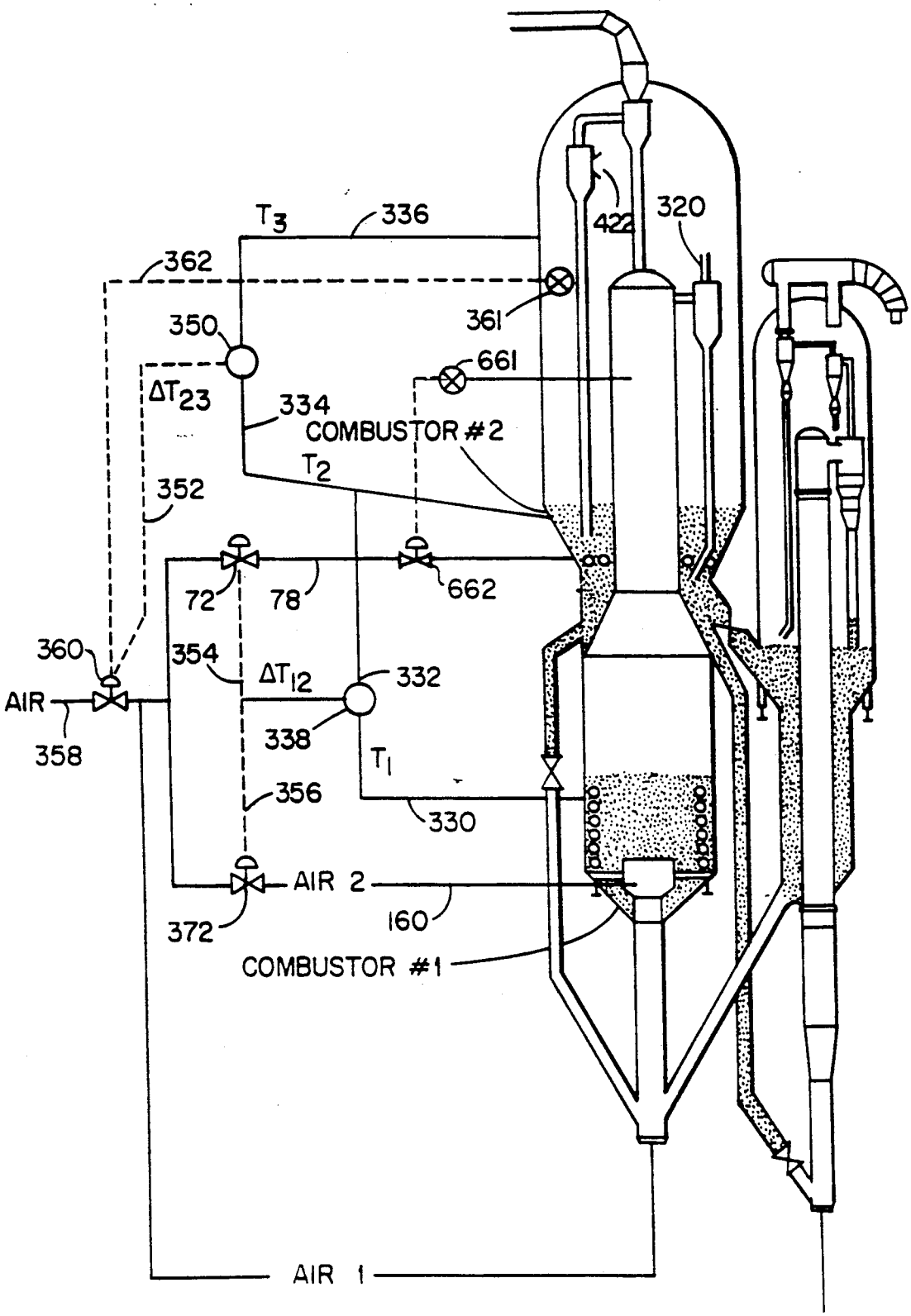
FIG. 3 is a simplified schematic view of an embodiment of the invention using flue gas compositions to control air flow to both stages of the regenerator.

It would be beneficial if the relative amounts of coke burning in the primary and secondary stage of the regenerator could be directly controlled. FIG. 3 provides a way to optimize coke burning in each stage of regeneration.

The FIG. 3 embodiment uses much of the hardware from the FIG. 1 embodiment, i.e., the primary difference in the FIG. 3 embodiment is simultaneous adjustment of both primary and secondary air. Air can be rationed between the two regenerations stages based on an analysis of flue gas compositions, or based on temperature differences. FIG. 3 includes symbols indicating temperature differences, e.g., $dT_{12}$ means that a signal is developed indicative of the temperature difference between two indicated temperatures, temperature 1 and temperature 2.

The amount of air added to the riser mixer is fixed, for simplicity, but this is merely to simplify the following analysis. The riser mixer air is merely part of the primary air, and could vary with any variations in flow of air to the coke combustor. It is also possible to operate the regenerator with no riser mixer at all, in which case spent catalyst, recycled regenerated catalyst, and primary air are all added directly to the coke combustor. The use of a riser mixer is preferred.

The control scheme will first be stated in general terms, then reviewed in conjunction with FIG. 3. The overall amount of combustion air, i.e., the total air to the regenerator, is controlled based on flue gas compositions or on differential temperature.

Controlling the second stage flue gas composition (either directly using an analyzer or indirectly using delta T to show afterburning) by apportioning the air added to each combustion zone allows unit operation to be optimized even when the operator does not know the individual optima for the first and second stages.

The FIG. 3 embodiment also allows air apportionment based on differences in the fluidized bed temperatures in each stage. The temperature difference between the fast fluidized bed coke combustor (1st stage) and the bubbling dense bed (2nd) stage, is an indication of how much coke escaped the first stage and was burned in the second stage. The particulars of each control scheme, as shown in FIG. 3 will now be reviewed.

The total air flow, in line 358 is controlled by means of a flue gas analyzer 361 or preferably by dT controller 350 which measures and controls the amount of afterburning above the second fluidized bed. The bubbling dense bed temperature (T2) is sensed by thermocouple 334, and the dilute phase temperature (T3) is monitored by thermocouple 336. These signals are the input to differential temperature controller 350, which generates a control signal based on dT23, or the difference in temperature between the bubbling dense bed (T2) and the dilute phase above the dense bed (T3). The control signal is transmitted via transmission means 352 (an air line, or a digital or analogue electrical signal or equivalent signal transmission means) to valve 360 which regulates the total air flow to the regenerator via line 358. A roughly analogous overall air control based on flue gas analysis is achieved using flue gas analyzer controller 361, sending a signal via means 362 to valve 360.

The apportionment of air between the primary and secondary stages of regeneration is controlled either by the differences in temperature of the two relatively dense phase beds in the regenerator, or by the composition of the flue gas from the primary stage.

Apportionment based on dT12 requires measurement of the temperature (T1) in the coke combustor fast fluidized bed as determined by thermocouple 330 and in the second fluidized bed (T2) as determined by thermocouple 332, which can and preferably does share the signal generated by thermocouple 334. Differential temperature controller 338 generates a signal based on dT12, or the difference in temperature between the two beds. Signals are sent via means 356 to valve 372 (primary air to the coke combustor) and via means 354 to valve 72 (secondary air to second fluidized bed).

If the delta T (dT12) becomes too large, it means that not enough coke burning is taking place in the coke combustor, and too much coke burning occurs in the second fluidized bed. The dT controller 338 will compensate by sending more combustion air to the coke combustor, and less to the second fluidized bed.

There are several other temperature control points which can be used besides the ones shown. The operation of the coke combustor can be measured by a fast fluidized bed temperature (as shown), by a temperature in the dilute phase of the coke combustor or in the dilute phase transport riser, a temperature measured in the primary cyclone or on a flue gas stream or catalyst stream discharged from the primary cyclone.

Air apportionment based on the flue gas composition from the coke combustor can also be be used to generate a signal indicative of the amount of coke combustion occurring in the fast fluidized bed. In this embodiment, flue gas analyzer controller 661 can measure a flue gas composition, usually O2, in the primary flue gas, and send a signal via transmission means 661 to flow control valve 662.

It should also be emphasized that the designations "primary air" and "secondary air" do not require that a majority of the coke combustion take place in the coke combustor. In most instances, the fast fluidized bed region will be the most efficient place to burn coke. There are other considerations, such as reduced steaming and reduced thermal deactivation of catalyst if regenerated in the second fluidized bed which may make it beneficial to burn most of the coke with the "secondary air". Shifting coke burning to the second fluidized bed, even if it is a low efficiency bubbling dense bed, will thus sometimes result in the most efficient regeneration of the catalyst.

It is possible to magnify or to depress the difference in temperature between the coke combustor and the second fluidized bed by changing the amount of hot regenerated catalyst which is recycled. Operation with large amounts of recycle, i.e., recycling more than 1 or 2 weights of catalyst from the bubbling dense bed per weight of spent catalyst, will depress temperature differences between the two regions. Differential temperature control can still be used, but the gain and/or setpoint on the controller may have to be adjusted because recycle of large amounts of catalyst from the second fluidized bed will increase the temperature in the fast fluidized bed coke combustor and reduce temperature differences.

Figure 4:
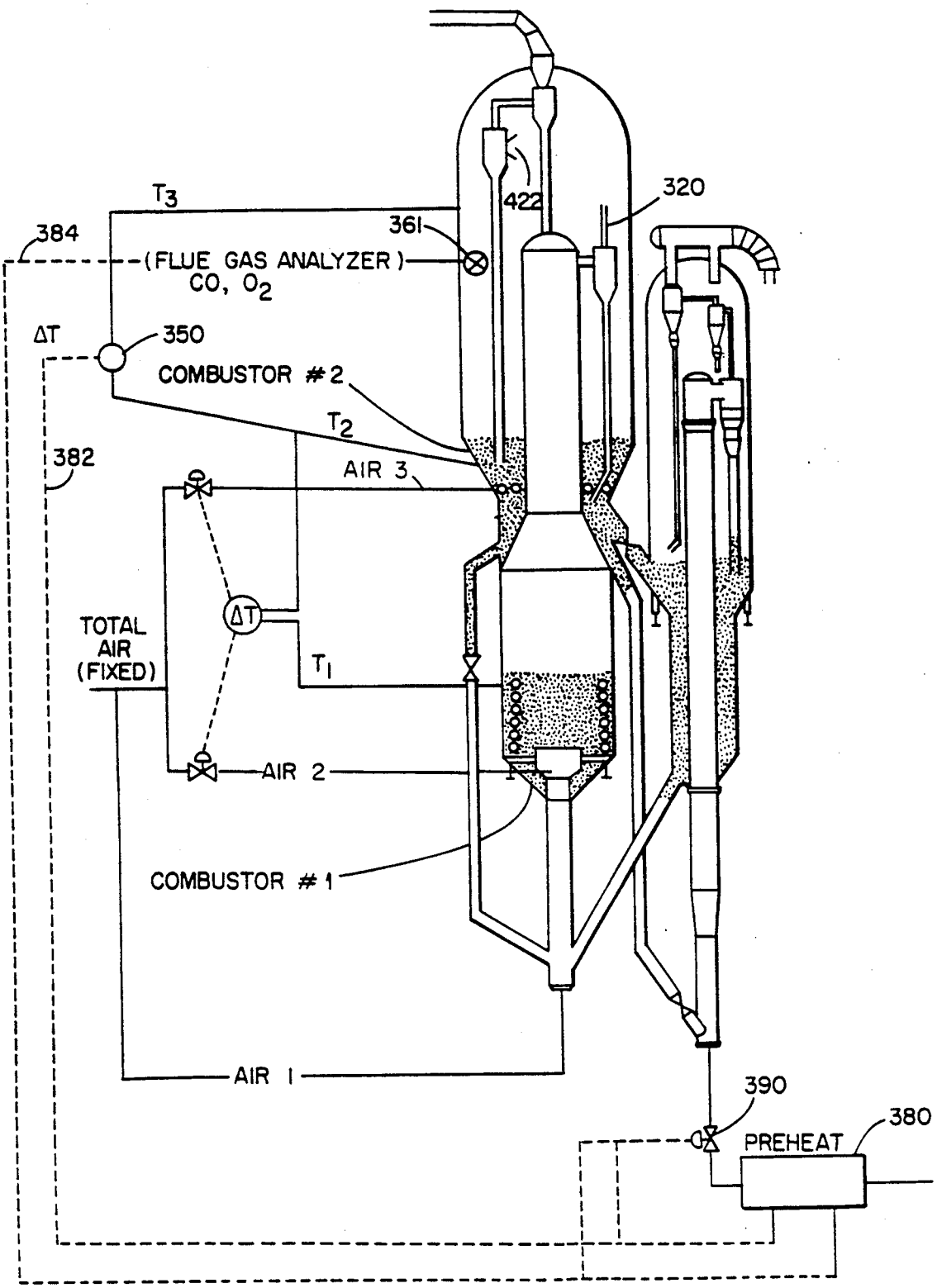
FIG. 4 is a simplified schematic view of an embodiment of the invention splitting constant air between both stages of the regenerator based on differences in bed temperatures, and controlling coke make with feed preheat or feed rate.

The control method of FIG. 3. will be preferred for most refineries. Another method of control is shown in FIG. 4, which can be used as an alternative to the FIG. 3 method. The FIG. 4 control method retains the ability to apportion combustion air between the primary and secondary stages of regeneration, but adjusts feed preheat, and/or feed rate, rather than total combustion air, to control coke make. The FIG. 4 control method is especially useful where a refiner's air blower capacity limits the throughput of the FCC unit. Leaving the air blower at maximum, and adjusting feed preheat and/or feed rate, will maximize the coke burning capacity of the unit by always running the air blower at maximum throughput.

In the FIG. 4 embodiment, the total amount of air added via line 358 is limited solely by the capacity of the compressor or air blower. The apportionment of air between primary and secondary stages of combustion is controlled as in the FIG. 3 embodiment. The feed rate and/or feed preheat are adjusted as necessary to maintain complete CO combustion in the first stage, and partial CO combustion in the second stage. The presence of large amounts of CO combustion promoter, and/or proper regeneration conditions in the coke combustor, will maintain complete CO combustion in the coke combustor, but only partial coke removal. If the unit gets behind in coke burning, the increased coke on catalyst in the second fluidized bed will show up as a higher CO/CO2 ratio, or the CO content of the flue gas above the second dense bed will increase, as measured by flue gas controller 361. The control method will correct the situation by decreasing coke, either by changing feed rate or feed preheat.

Feed preheat can affect coke make because the FCC reactor usually operates to control riser top temperature. The hydrocarbon feed is mixed with sufficient hot, regenerated catalyst to maintain a given riser top temperature. The temperature can be measured at other places in the reactor, as in the middle of the riser, at the riser outlet, cracked product outlet, or spent catalyst temperature before or after stripping, but usually the riser top temperature is used to control the amount of catalyst added to the base of the riser to crack fresh feed. If the feed is preheated to a very high temperature, and much or all of the feed is added as a vapor, less catalyst will be needed as compared to operation with a relatively cold liquid feed which is vaporized by hot catalyst. High feed preheat reduces the amount of catalyst circulation needed to maintain a given riser top temperature, and this reduced catalyst circulation rate reduces coke make.

If the CO content of the flue gas above the second, usually bubbling, dense bed increases this indicates that the regenerator has some additional coke burning capacity. A composition based control signal from analyzer controller 361 may be sent via signal transmission means 384 to feed preheater 380 or to valve 390. Decreasing feed preheat, i.e., a cooler feed, increases coke make. Increasing feed rate increases coke make. Either action, or both together, will increase the coke make, and bring flue gas composition back to the desired point. A differential temperature controller 350 may generate an analogous signal, transmitted via means 382 to adjust preheat and/or feed rate.

Figure 5:
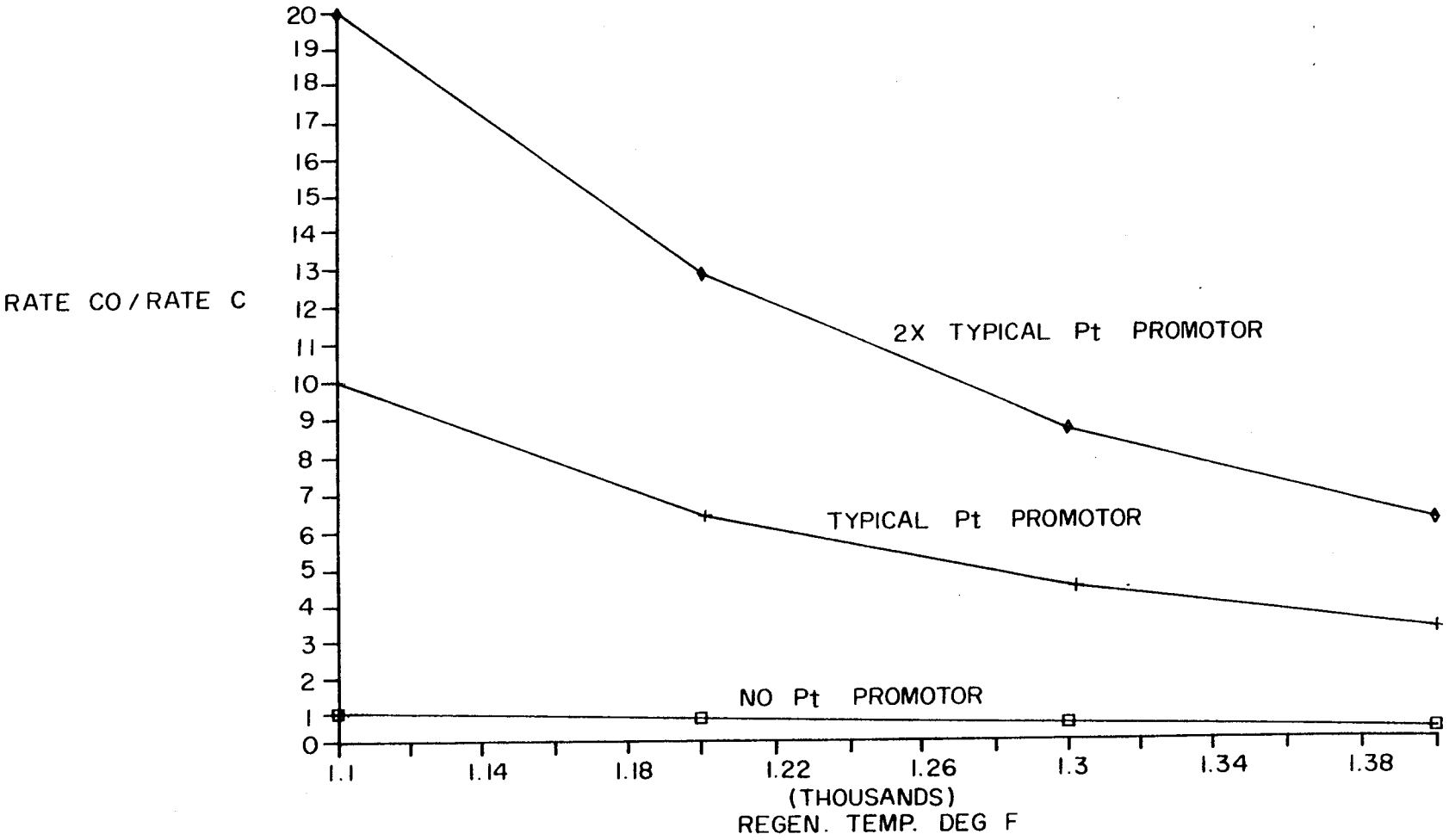
FIG. 5 shows relative CO burning rates of unpromoted and Pt promoted FCC catalyst.

FIG. 5 shows the relative rate of CO burning as compared to the relative rate of carbon or coke burning on FCC catalyst. The significance of the figure is that addition of Pt, or other equivalent CO combustion promoter, greatly increases the rate of CO combustion relative to coke combustion. Most FCC units that operate in complete CO combustion mode operate with 0.1 to 1.0 ppm Pt. The actual amount of Pt is not determinative, because new Pt promoter is more active than old promoter, and some supports make the Pt more effective. By doubling the amount of Pt promoter typically used in a refinery, it is possible to greatly increase the rate of CO combustion, and achieve complete CO combustion in a high efficiency regenerator, without completely regenerating the catalyst as it passes through the coke combustor and dilute phase transport riser.

With sufficient CO combustion promoter, an operator can completely burn CO formed in the coke combustor and/or transport riser. The operator can limit the amount of coke that is burned by limiting the residence time in the coke combustor, shifting air addition to downstream portions of the coke combustor or (preferably) into the dilute phase transport riser inlet and/or limiting the temperature in the coke combustor.

Residence time can be controlled by adjusting the catalyst holdup in the coke combustor. This can be done by changing the size of the vessels, which is not a practical means of control or by recycling inert gas to increase superficial vapor velocity without increasing oxygen content.

Shifting air addition to downstream, i.e., upper regions of the coke combustor or lower or middle regions of the dilute phase transport riser provides a more direct way of limiting coke combustion (to CO in the coke combustor) while still achieving complete CO combustion in the dilute phase, short residence time, transport riser.

Control of temperature in the coke combustor will be the easiest way to limit coke combustion in most refineries.

Figure 6:
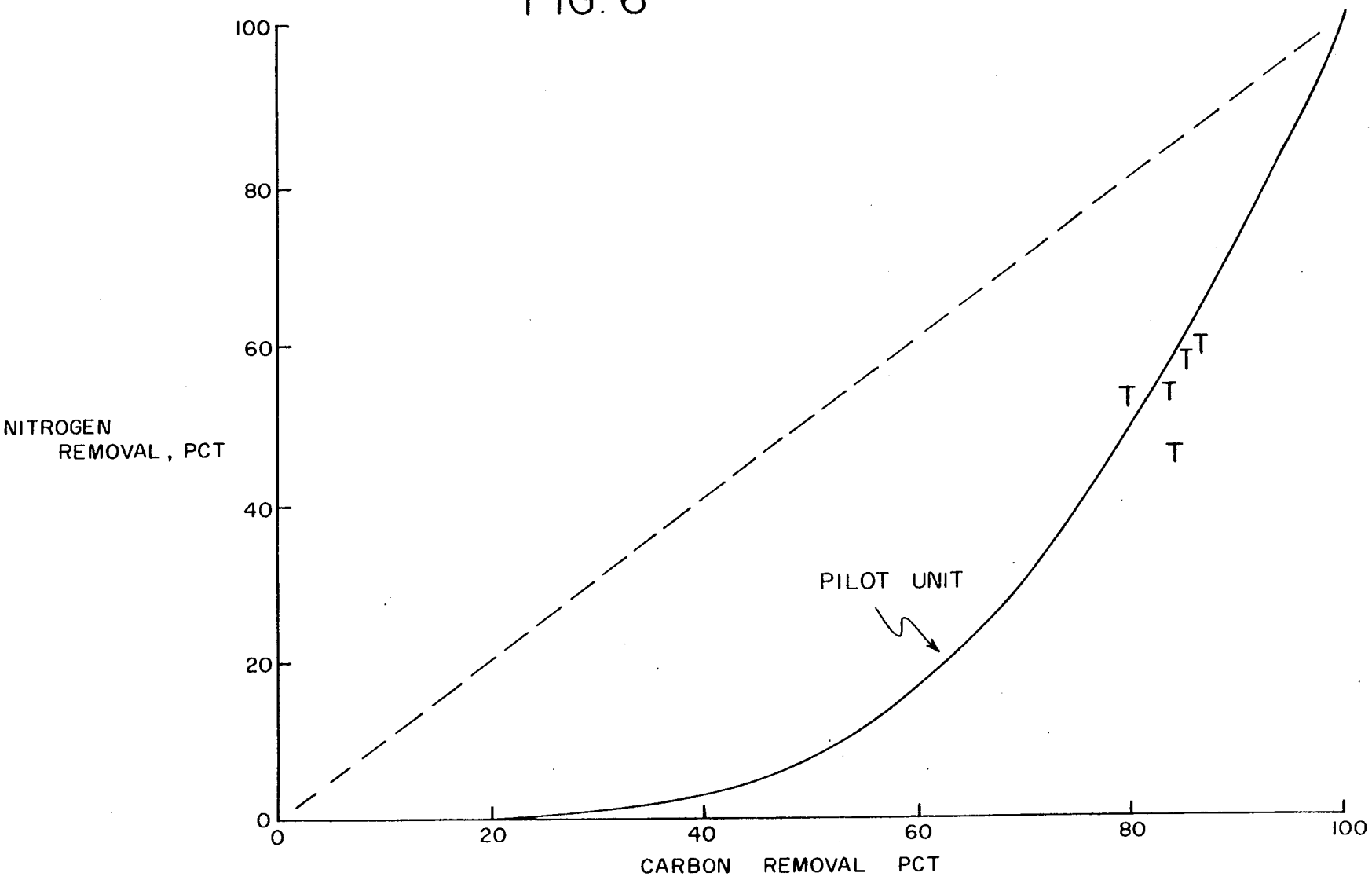
FIG. 6 shows relative nitrogen and carbon burning rates on FCC catalyst.

FIG. 6 shows the relative rates of burning of carbon and nitrogen on spent catalyst. Sulfur, not shown, burns at about the same rate as carbon. The significance of this is that coke and sulfur combustion can occur under oxidizing conditions in the coke combustor/transport riser, and a significant amount of sulfur can be captured on conventional sulfur getters such as alumina. The burning of nitrogen compounds, and potential formation of NOx, can be shifted to the second stage of regeneration, where the generally reducing conditions will reduce or eliminate much of the NOx. In this way a significant and beneficial amount of SOx capture can be achieved even while NOx emissions are being minimized.

The staged regeneration will also reduce hydrothermal deactivation of catalyst, and minimize the damage caused by vanadium.

Other Embodiments. A number of mechanical modifications may be made to the high efficiency regenerator without departing from the scope of the present invention. It is possible to use the control scheme of the present invention even when additional catalyst/flue gas separation means are present. As an example, the riser mixer 60 may discharge into a cyclone or other separation means contained within the coke combustor. The resulting flue gas may be separately withdrawn from the unit, without entering the dilute phase transport riser. Such a regenerator configuration is shown in EP A 0259115, published on Mar. 9, 1988 and in U.S. Ser. No. 188,810 which is incorporated herein by reference.

Now that the invention has been reviewed in connection with the embodiments shown in the Figures, a more detailed discussion of the different parts of the process and apparatus of the present invention follows. Many elements of the present invention can be conventional, such as the cracking catalyst, or are readily available from vendors, so only a limited discussion of such elements is necessary.

FCC Feed

Any conventional FCC feed can be used. The process of the present invention is especially useful for processing difficult charge stocks, those with high levels of CCR material, exceeding 2, 3, 5 and even 10 wt % CCR. The process tolerates feeds which are relatively high in nitrogen content, and which otherwise might produce unacceptable NOx emissions in conventional FCC units, operating with complete CO combustion.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

FCC Catalyst

Any commercially available FCC catalyst may be used. The catalyst can be 100% amorphous, but preferably includes some zeolite in a porous refractory matrix such as silica-alumina, clay, or the like. The zeolite is usually 5–40 wt.% of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Additives for removal of SOx are available from catalyst suppliers, such as Davison's "R" or Katalistiks International, Inc.'s "DeSox."

CO combustion additives are available from most FCC catalyst vendors.

The FCC catalyst composition, per se, forms no part of the present invention.

FCC Reactor Conditions

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds.

It is preferred, but not essential, to use an atomizing feed mixing nozzle in the base of the riser reactor, such as ones available from Bete Fog. More details of use of such a nozzle in FCC processing are disclosed in U.S. Ser. No. 424,420, which is incorporated herein by reference.

It is preferred, but not essential, to have a riser acceleration zone in the base of the riser, as shown in FIGS. 1 and 2.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred but not essential, to rapidly strip the catalyst, immediately after it exits the riser, and upstream of the conventional catalyst stripper. Stripper cyclones disclosed in U.S. Ser. No. 4,173,527, Schatz and Heffley, may be used.

It is preferred, but not essential, to use a hot catalyst stripper. Hot strippers heat spent catalyst by adding some hot, regenerated catalyst to spent catalyst. The hot stripper reduces the hydrogen content of the spent catalyst sent to the regenerator and reduces the coke content as well. Thus, the hot stripper helps control the temperature and amount of hydrothermal deactivation of catalyst in the regenerator. A good hot stripper design is shown in U.S. Pat. No. 4,820,404 Owen, which is incorporated herein by reference. A catalyst cooler cools the heated catalyst before it is sent to the catalyst regenerator.

The FCC reactor and stripper conditions, per se, can be conventional and form no part of the present invention.

Catalyst Regeneration

The process and apparatus of the present invention can use many conventional elements most of which are conventional in FCC regenerators.

The present invention uses as its starting point a high efficiency regenerator such as is shown in the Figures, or as shown. The essential elements include a coke combustor, a dilute phase transport riser and a second fluidized bed, which is usually a bubbling dense bed. The second fluidized bed can also be a turbulent fluidized bed, or even another fast fluidized bed, but unit modifications will then frequently be required. Preferably, a riser mixer is used. These elements are generally known.

Preferably there is quick separation of catalyst from steam laden flue gas exiting the regenerator transport riser. A significantly increased catalyst inventory in the second fluidized bed of the regenerator, and means for adding a significant amount of combustion air for coke combustion in the second fluidized bed are preferably present or added.

Each part of the regenerator will be briefly reviewed below, starting with the riser mixer and ending with the regenerator flue gas cyclones.

Spent catalyst and some combustion air are charged to the riser mixer 60. Some regenerated catalyst, recycled through the catalyst stripper, will usually be mixed in with the spent catalyst. Some regenerated catalyst may also be directly recycled to the base of the riser mixer 60, either directly or, preferably, after passing through a catalyst cooler. Riser mixer 60 is a preferred way to get the regeneration started. The riser mixer typically burns most of the fast coke (probably representing entrained or adsorbed hydrocarbons) and a very small amount of the hard coke. The residence time in the riser mixer is usually very short. The amount of hydrogen and carbon removed, and the reaction conditions needed to achieve this removal are reported below.

RISER MIXER CONDITIONS

| RISER MIXER CONDITIONS | Good | Preferred | Best |
|---|---|---|---|
| Inlet Temp. °F. | 900–1200 | 925–1100 | 950–1050 |
| Temp. Increase, F | 10–200 | 25–150 | 50–100 |
| Catalyst Residence Time, Seconds | 0.5–30 | 1–25 | 1.5–20 |
| Vapor velocity, fps | 5–100 | 7–50 | 10–25 |
| % total air added | 1–25 | 2–20 | 3–15 |
| H2 Removal, % | 10–40 | 12–35 | 15–30 |
| Carbon Removal, % | 1–10 | 2–8 | 3–7 |

Although operation with a riser mixer is preferred, it is not essential, and in many units is difficult to implement because there is not enough elevation under the coke combustor in which to fit a riser mixer. Spent, stripped catalyst may be added directly to the coke combustor, discussed next.

The coke combustor 62 contains a fast fluidized dense bed of catalyst. It is characterized by relatively high superficial vapor velocity, vigorous fluidization, and a relatively low density dense phase fluidized bed. Most of the coke can be burned in the coke combustor. The coke combustor will also efficiently burn "fast coke", primarily unstripped hydrocarbons, on spent catalyst. When a riser mixer is used, a large portion, perhaps most, of the "fast coke" will be removed upstream of the coke combustor. If no riser mixer is used, relatively easy job of burning the fast coke will be done in the coke combustor.

The removal of hydrogen and carbon achieved in the coke combustor alone (when no riser mixer is used) or in the combination of the coke combustor and riser mixer, is presented below. The operation of the riser mixer and coke combustor can be combined in this way, because what is important is that catalyst leaving the coke combustor have specified amounts of carbon and hydrogen removed.

| COKE COMBUSTOR CONDITIONS | Good | Preferred | Best |
|---|---|---|---|
| Dense Bed Temp. °F. | 900–1300 | 925–1275 | 950–1250 |
| Catalyst Residence Time, Seconds | 10–500 | 20–240 | 30–180 |
| Vapor velocity, fps | 1–40 | 2–20 | 3.5–15 |
| % total air added | 30–95 | 40–90 | 45–85 |
| H2 Removal, % | 40–99 | 50–98 | 70–95 |
| Carbon Removal, % | 30–95 | 40–90 | 45–85 |

The dilute phase transport riser 83 forms a dilute phase where efficient afterburning of CO to CO2 can occur, or as practiced herein, when CO combustion is constrained, efficiently transfers catalyst from the fast fluidized bed through a catalyst separation means to the second dense bed.

Additional air can be added to the dilute phase transport riser. This is a good way to achieve complete CO combustion in the transport riser, because the short catalyst residence time will not generally permit much additional coke combustion. In this way the coke combustor can be starved for air somewhat, to limit coke combustion, and the air normally added to the base of the coke combustor shifted to the transport riser, where the gas phase reaction of CO with O2 proceeds quickly, especially if 0.5 to 5 wt ppm Pt are present on the equilibrium catalyst.

TRANSPORT RISER CONDITIONS

| TRANSPORT RISER CONDITIONS | Good | Preferred | Best |
|---|---|---|---|
| Inlet Temp. °F. | 900-1300 | 925-1275 | 950-1250 |
| Outlet Temp. °F. | 925-1450 | 975-1400 | 1000-1350 |
| Catalyst Residence Time, Seconds | 1-60 | 2-40 | 3-30 |
| Vapor velocity, fps | 6-50 | 9-40 | 10-30 |
| % additional air in | 0-40 | 0-10 | 0-5 |
| H2 Removal, % | 0-25 | 1-15 | 2-10 |
| Carbon Removal, % | 0-15 | 1-10 | 2-5 |

Quick and effective separation of catalyst from flue gas exiting the dilute phase transport riser is not essential but is very beneficial for the process. The rapid separation of catalyst from flue gas in the dilute phase mixture exiting the transport riser removes the water laden flue gas from the catalyst upstream of the second fluidized bed.

Multistage regeneration can be achieved in older high efficiency regenerators which do not have a very efficient means of separating flue gas from catalyst exiting the dilute phase transport riser. Even in these older units a reasonably efficient multistage regeneration of catalyst can be achieved by reducing the air added to the coke combustor and increasing the air added to the second fluidized bed. The reduced vapor velocity in the transport riser, and increased vapor velocity immediately above the second fluidized bed, will more or less segregate the flue gas from the transport riser from the flue gas from the second fluidized bed.

Rapid separation of flue gas from catalyst exiting the dilute phase transport riser is still the preferred way to operate the unit. This flue gas stream contains a fairly large amount of steam, from adsorbed stripping steam entrained with the spent catalyst and from water of combustion. Many FCC regenerators operate with 5-10 psia steam partial pressure in the flue gas. In the process and apparatus of one embodiment of the present invention, the dilute phase mixture is quickly separated into a catalyst rich dense phase and a catalyst lean dilute phase.

The quick separation of catalyst and flue gas sought in the regenerator transport riser outlet is very similar to the quick separation of catalyst and cracked products sought in the riser reactor outlet.

The most preferred separation system is discharge of the regenerator transport riser dilute phase into a closed cyclone system such as that disclosed in U.S. Pat. No. 4,502,947. Such a system rapidly and effectively separates catalyst from steam laden flue gas and isolates and removes the flue gas from the regenerator vessel. This means that catalyst in the regenerator downstream of the transport riser outlet will be in a relatively steam free atmosphere, and the catalyst will not deactivate as quickly as in prior art units.

Other methods of effecting a rapid separation of catalyst from steam laden flue gas may also be used, but most of these will not work as well as the use of closed cyclones. Acceptable separation means include a capped riser outlet discharging catalyst down through an annular space defined by the riser top and a covering cap.

In a preferred embodiment, the transport riser outlet may be capped with radial arms, not shown, which direct the bulk of the catalyst into large diplegs leading down into the second fluidized bed of catalyst in the regenerator. Such a regenerator riser outlet is disclosed in U.S. Pat. No. 4,810,360, which is incorporated herein by reference.

The embodiment shown in FIG. 1 is highly preferred because it is efficient both in separation of catalyst from flue gas and in isolating flue gas from further contact with catalyst. Well designed cyclones can recover in excess of 95, and even in excess of 98 % of the catalyst exiting the transport riser. By closing the cyclones, well over 95%, and even more than 98% of the steam laden flue gas exiting the transport riser can be removed without entering the second fluidized bed. The other separation/isolation means discussed about generally have somewhat lower efficiency.

Regardless of the method chosen, at least 90 % of the catalyst discharged from the transport riser preferably is quickly discharged into a second fluidized bed, discussed below. At least 90 % of the flue gas exiting the transport riser should be removed from the vessel without further contact with catalyst. This can be achieved to some extent by proper selection of bed geometry in the second fluidized bed, i.e., use of a relatively tall but thin containment vessel 80, and careful control of fluidizing conditions in the second fluidized bed.

The second fluidized bed achieves a second stage of regeneration of the catalyst, in a relatively dry atmosphere. The multistage regeneration of catalyst is beneficial from a temperature standpoint alone, i.e., it keeps the average catalyst temperature lower than the last stage temperature. This can be true even when the temperature of regenerated catalyst is exactly the same as in prior art units, because when staged regeneration is used the catalyst does not reach the highest temperature until the last stage. The hot catalyst has a relatively lower residence time at the highest temperature, in a multistage regeneration process.

The second fluidized bed bears a superficial resemblance to the second dense bed used in prior art, high efficiency regenerators. There are several important differences which bring about profound changes in the function of the second fluidized bed.

In prior art second dense beds, the catalyst was merely collected and recycled (to the reactor and frequently to the coke combustor). Catalyst temperatures were typically 1250-1350 F., with some operating slightly hotter, perhaps approaching 1400 F. The average residence time of catalyst was usually 60 seconds or less. A small amount of air, typically around 1 or 2 % of the total air added to the regenerator, was added to the dense bed to keep it fluidized and enable it to flow into collectors for recycle to the reactor. The superficial gas velocity in the bed was typically less than 0.5 fps, usually 0.1 fps. The bed was relatively dense, bordering on incipient fluidization. This was efficient use of the second dense bed as a catalyst collector, but meant that little or no regeneration of catalyst was achieved in the second dense bed. Because of the low vapor velocity in the bed, very poor use would be made of even the small amounts of oxygen added to the bed. Large fluidized beds such as this are characterized, or plagued, by generally poor fluidization, and relatively large gas bubbles.

In our process, we make the second fluidized bed do much more work towards regenerating the catalyst. The first step is to provide substantially more residence time in the second fluidized bed. We must have at least 1 minute, and preferably have a much longer residence time. This increased residence time can be achieved by adding more catalyst to the unit, and letting it accumulate in the second fluidized bed.

Much more air is added to our fluidized bed, for several reasons. First, we are doing quite a lot of carbon burning in the second fluidized bed, so the air is needed for combustion. Second, we need to improve the fluidization in the second fluidized bed, and much higher superficial vapor velocities are necessary. We also decrease, to some extent, the density of the catalyst in the second fluidized bed. This reduced density is a characteristic of better fluidization, and also somewhat beneficial in that although our bed may be twice as high as a bed of the prior art it will not have to contain twice as much catalyst.

Because so much more air is added in our process, we prefer to retain the old fluffing or fluidization rings customarily used in such units, and add an additional air distributor or air ring alongside of, or above, the old fluffing ring.

Although much more air is added, the amount of air added should be limited so that only partial CO combustion conditions prevail in the second dense bed and in the dilute phase region above it.

| SECOND DENSE BED CONDITIONS | | | |
|---|---|---|---|
| | Good | Preferred | Best |
| Temperature °F. | 1200–1700 | 1300–1600 | 1350–1500 |
| Catalyst Residence Time, Seconds | 30–500 | 45–200 | 60–180 |
| Vapor velocity, fps | 0.5–5 | 1–4 | 1.5–3.5 |
| % total air added | 0–90 | 2–60 | 5–40 |
| H2 Removal, % | 0–25 | 1–10 | 1–5 |
| Carbon Removal, % | 10–70 | 5–60 | 10–40 |

Operating the second fluidized bed with more catalyst inventory, and higher superficial vapor velocity, allows an extra stage of catalyst regeneration, either to achieve cleaner catalyst or to more gently remove the carbon and thereby extend catalyst life. Enhanced stability is achieved because much of the regeneration, and much of the catalyst residence time in the regenerator, is under drier conditions than could be achieved in prior art designs.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. Pt can be replaced by other metals, but usually more metal is then required. An amount of promoter which would give a CO oxidation activity equal to 0.5 to 5 wt. ppm of platinum is preferred.

DISCUSSION

The process of the present invention also permits continuous on stream optimization of the catalyst regeneration process. Two powerful and sensitive methods of controlling air addition rates permit careful fine tuning of the process. Achieving a significant amount of coke combustion in the second fluidized bed of a high efficiency regenerator also increases the coke burning capacity of the unit, for very little capital expenditure.

Measurement of oxygen concentration in flue gas exiting the transport riser, and to a lesser extent measurement of CO or hydrocarbons or oxidizing or reducing atmosphere, gives refiners a way to make maximum use of air blower capacity.

Measurement of delta T, when cyclone separators are used on the regenerator transport riser outlet, provides a very sensitive way to monitor the amount of afterburning occurring, and provides another way to maximize use of existing air blower capacity.

Complete CO combustion in the first stage, and partial CO combustion in the second stage, will minimize the damage done to the catalyst by metals (primarily Ni and V). Surprisingly, the process creates conditions in the regenerator which allow for simultaneous capture of much SOx, while minimizing NOx emissions.

It may be necessary to bring in auxiliary compressors, or a tank of oxygen gas, to supplement the existing air blower. Although many existing high efficiency regenerators can, using the process of the present invention, achieve large increases in coke burning capacity by shifting the coke combustion to the second fluidized bed, the existing air blowers will almost never be sized large enough to take maximum advantage of the heretofore dormant coke burning capacity of the second fluidized bed.

Operation with the second stages in partial CO combustion will increase somewhat the coke burning potential of the high efficiency regenerator design. This may seem a strange use of the high efficiency regenerator, originally designed to achieve complete CO combustion, but there are many benefits.

Coke combustion is maximized by partial CO combustion, as is well known. One mole of air is needed to burn one mole of carbon to CO2, while only half as much air is needed to burn the carbon to CO. This roughly doubles the coke burning capacity of the unit, at least to the extent that coke combustion is achieved in the second stage (second fluidized bed). By severely limiting CO combustion, it is possible to shift much of the heat generation, and high temperature, to a downstream CO boiler.

We claim:

1. A fluidized catalytic cracking process wherein a heavy hydrocarbon feed comprising hydrocarbons and sulfur and nitrogen compounds and having a boiling point above about 650 F. is catalytically cracked to lighter products comprising the steps of:

a. catalytically cracking the feed in a catalytic cracking zone operating at catalytic cracking conditions by contacting the feed with a source of hot regenerated catalyst to produce a cracking zone effluent mixture having an effluent temperature and comprising cracked products and spent cracking catalyst containing strippable hydrocarbons and coke containing nitrogen and sulfur compounds;

b. separating the cracking zone effluent mixture into a cracked product rich vapor phase and a solids rich phase comprising the spent catalyst and strippable hydrocarbons;

c. stripping the separated spent catalyst with a stripping gas to remove strippable compounds from spent catalyst and produce stripped catalyst;

d. regenerating said stripped catalyst in a primary regeneration stage, comprising a fast fluidized bed coke combustor having at least one inlet for primary combustion gas and for spent catalyst, and an overhead outlet for at least partially regenerated catalyst and flue gas, and also comprising a contiguous, superimposed, dilute phase transport riser having an opening at the base connective with the coke combustor and an outlet at an upper portion thereof for discharge of partially regenerated catalyst and primary flue gas, at primary regeneration conditions adapted to completely afterburn CO formed during coke combustion to CO2, and sufficient to burn at least 40 % of the coke and sulfur compounds on the catalyst under oxidizing conditions while retaining at least 30% of the nitrogen compounds on said catalyst to produce partially regenerated catalyst containing nitrogen compounds and flue gas comprising SOx;

e. discharging and separating the primary flue gas from partially regenerated catalyst and collecting said partially regenerated catalyst as a second fluidized bed of partially regenerated catalyst in a secondary regeneration zone maintained at catalyst regeneration conditions and regenerating under partial CO oxidation conditions said partially regenerated catalyst to remove additional coke from said catalyst and to burn the nitrogen compounds present in said stripped catalyst under reducing conditions to produce regenerated catalyst and a secondary flue gas stream comprising at least 1 mole % CO; and f. recycling to the catalytic cracking process hot regenerated catalyst from said second fluidized bed.

2. The process of claim 1 wherein a majority of the coke on spent catalyst is removed in said fast fluidized bed coke combustor and transport riser under oxidizing conditions and a majority of the nitrogen compounds are burned in said second fluidized bed under reducing conditions.

3. The process of claim 1 wherein SOx getter or SOx adsorbent is added to said catalyst in an amount sufficient to adsorb SOx in said dilute phase transport riser.

4. The process of claim 1 wherein 0.5 to 5 ppm Pt is added to said catalyst to promote CO oxidation in said transport riser and to promote oxidation of oxides of sulfur formed during coke combustion in said fast fluidized bed coke combustor.

5. A process for regenerating spent fluidized catalytic cracking catalyst used in a catalytic cracking process wherein a heavy hydrocarbon feed stream is preheated in a preheating means, catalytically cracked in a cracking reactor by contact with a source of hot, regenerated cracking catalyst to produce cracked products and spent catalyst which is regenerated in a high efficiency fluidized catalytic cracking catalyst regenerator comprising a fast fluidized bed coke combustor having at least one inlet for spent catalyst, at least one inlet for regeneration gas, and an outlet to a superimposed dilute phase transport riser having an inlet at the base connected to the coke combustor and an outlet the top connected to a separation means which separates catalyst and primary flue gas and discharges catalyst into a second fluidized bed, to produce regenerated cracking catalyst comprising regenerating said spent catalyst in at least two stages, and maintaining the first stage in complete CO combustion and the second stage in partial CO combustion by:

a) partially regenerating said spent catalyst with a controlled amount, sufficient to burn from 10 to 90 % of the coke on the spent catalyst to carbon oxides, of a primary regeneration gas comprising oxygen or an oxygen containing gas in a primary regeneration zone comprising said coke combustor and transport riser operating at primary catalyst regeneration conditions sufficient to completely afterburn CO produced during coke combustion to CO2 and discharging from the transport riser partially regenerated catalyst and a primary flue gas stream;

b) completing the regeneration of said partially regenerated catalyst with a set amount of a secondary regeneration gas comprising oxygen or an oxygen containing gas in a secondary regeneration zone comprising a second fluidized bed operating at secondary catalyst regeneration conditions sufficient to limit the combustion of CO to CO2 and burn additional coke to carbon oxides and regenerate said catalyst.

6. The process of claim 5 wherein the rate of addition of primary combustion gas is set to maintain constant a flue gas composition or to maintain constant a differential temperature indicating afterburning in flue gas from said second fluidized bed.

7. The process of claim 5 wherein the rate of addition of primary combustion gas maintained constant and the rate of addition of secondary combustion gas is set to maintain constant a flue gas composition in flue gas from said second fluidized bed or to maintain constant a differential temperature indicating afterburning in flue gas from said second fluidized bed.

8. The process of claim 5 wherein the primary combustion gas is added to said fast fluidized bed coke combustor and also separately added to said dilute phase transport riser, and the rate of addition of primary combustion gas to said fast fluidized bed is limited to limit coke combustion therein to produce limited conversion of coke to CO and CO2 and the rate of addition of primary combustion gas to said dilute phase transport riser is controlled to provide sufficient combustion gas to completely afterburn CO to CO2 in said transport riser.

9. The process of claim 5 wherein the total amount of regeneration gas added is apportioned between said primary and said secondary regenerator to maintain constant a temperature between said fast fluidized bed coke combustor and said second fluidized bed.

10. The process of claim 5 wherein the primary and secondary flue gas streams are combined and the total amount of regeneration gas added is apportioned between said primary and said secondary regenerator to maintain constant a temperature differential indicating the amount of afterburning that occurs in said combined flue gas stream.

11. The process of claim 5 wherein a constant amount of regeneration gas added to said regenerator, and said constant amount is apportioned between said primary and secondary stages to maintain constant a temperature difference between said primary stage and said secondary stage, or a differential temperature indicating afterburning in a flue gas stream and the amount of coke relative to the amount of regeneration gas is controlled by adjusting at least one of the feed preheat, the feed rate or both to change the coke production.

12. The process of claim 11 wherein the feed rate is changed to change the coke production.

13. The process of claim 11 wherein the feed preheat is changed to change the coke production.

14. The process of claim 5 wherein at least a portion of the catalyst from the second fluidized bed is recycled to the coke combustor.

15. The process of claim 14 wherein the amount of catalyst recycled to the coke combustor is adjusted to maintain constant a composition or a temperature or a differential temperature indicating afterburning in a flue gas stream.

16. The process of claim 5 wherein the spent catalyst is added to said coke combustor via a riser mixer having an inlet in a base portion thereof for said spent catalyst, recycled regenerated catalyst from said second fluidized bed, and for regeneration gas, and an outlet in an upper portion of said riser mixer in a lower portion of said coke combustor.

17. The process of claim 5 wherein the second fluidized bed comprises a bubbling dense phase fluidized bed.

18. The process of claim 5 wherein the catalyst contains a CO combustion promoter which is added to maintain constant a composition or a temperature or a differential temperature indicating afterburning in a flue gas stream.

* * * * *